United States Patent [19]

Lachance

[11] 4,425,984

[45] Jan. 17, 1984

[54] REMOVABLE HANDRAIL FOR LADDERS

[76] Inventor: Paul Lachance, 100 Division St., Rockland, Mass. 02370

[21] Appl. No.: 406,266

[22] Filed: Aug. 9, 1982

[51] Int. Cl.[3] ..... E06C 5/36

[52] U.S. Cl. ..... 182/106

[58] Field of Search ..... 182/106, 107, 108; 5/426; 248/211, 238

[56] References Cited

U.S. PATENT DOCUMENTS

| | | | |
|---|---|---|---|
| 2,859,454 | 11/1958 | Beckwell | 5/426 |
| 2,873,904 | 2/1959 | McCormick | 182/106 |
| 2,944,625 | 7/1960 | Shore | 182/106 |
| 3,059,723 | 10/1962 | Shore | 182/107 |
| 3,097,370 | 7/1963 | Murcott | 182/106 |
| 3,160,383 | 12/1964 | Lamm | 248/211 |
| 3,752,262 | 8/1973 | Helms | 182/178 |
| 3,792,750 | 2/1974 | Madison | 248/238 |
| 4,293,055 | 10/1981 | Hooser | 182/106 |

*Primary Examiner*—R. P. Machado

*Attorney, Agent, or Firm*—Donald W. Meeker

[57] ABSTRACT

Parallel tubular arms removably slide into the openings through the openings in the side rails and the hollow rungs of aluminum ladders. A swivel on at least one arm protruding through both ladder rails turns to secure the handrail to the ladder. Orthogonal extensions of the arms support the handrail in a fixed position away from the ladder. Depending on the relative lengths of the supports the handrail may be in parallel or sloping alignment with the ladder. Handrails may be installed on both sides of the ladder and a restraining means secured between the handrails.

12 Claims, 6 Drawing Figures

REMOVABLE HANDRAIL FOR LADDERS

DESCRIPTION

BACKGROUND OF THE INVENTION

TECHNICAL FIELD

The invention relates to ladders provided with handrails and in particular to ladders provided with removable handrails.

BACKGROUND ART

Most prior art ladders do not provide handrails as an extra safety means so that occasionally people fall from ladders with no protruding rails to grasp.

In cases where railings are provided on ladders, such as on fire-fighting apparatus, or on permanently installed ladders used in place of stairs, as on a ship, installation of the railing is an involved procedure and moving or removing the railing would be very difficult.

Most prior art ladders do not provide a secure restraining means to be used in conjunction with a double railing and none provide portability to adjust the location as desired.

DISCLOSURE OF INVENTION

The primary object of the present invention is to provide extra safety for ladders in the form of a handrail which may be attached to any ladder provided with cylindrical bores through the ladder rails and rungs such as aluminum extension ladders or any ladders through which holes may be bored in the side rails. Two cylindrical rods protrude from the handrail to slide into the openings in the ladder rails.

Another object of the invention is to provide a hand rail for a ladder which may be attached securely or removed as desired with a minimum of effort by providing a one-step sliding means to install the handrail and a simple twist means to secure the handrail to the ladder.

A further object is to provide an adjustable handrail which can be moved to any rung locations on the ladder as desired by sliding the handrail into any of the holes located along the entire length of the ladder.

A still further object of the invention is to provide the option of mounting a handrail on each of the two ladder rails for extra safety.

Another object is to provide a safety belt, chain or other retaining device secured between two removable handrails mounted one on each of the two ladder rails.

BRIEF DESCRIPTION OF THE DRAWINGS

Further objects and the entire scope of the invention will become apparent in the following detailed description and in the appended claims. The accompanying drawings display the general construction and operation principle of the invention; it is to be understood, however, that the drawings are furnished only by way of illustration and not in limitation of the invention. In the drawings:

BEST MODE FOR CARRYING OUT THE INVENTION

Figure 1:
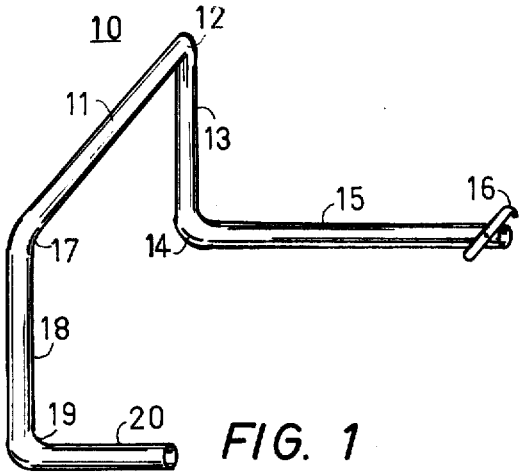
FIG. 1 is a perspective view of the preferred embodiment of the invention with a parallel handrail and one long and one short attaching rods.

In FIG. 1 the preferred embodiment of the removable handrail 10 is formed from a single piece of rigid tubing permanently bent in four places 12, 14, 17, and 19 to form the components of the handrail. A straight rod may be bent at two spaced points 12 and 17, located off-center, in one operation to form a handrail portion 11 for users to grasp. Although orthogonal bends are shown, other angles are also possible.

The uneven, U-shaped piece thus formed may then be bent at two points 14 and 19, equidistant from previously formed bends 12 and 17. Again this double bend might be performed in one operation. Thus forming supporting portions 13 and 18 which hold the handrail 11 in a fixed position away from the ladder. Orthogonal angles support the handrail straight out from the ladder. Larger angles are possible for tilting the handrail further out to the side of the ladder.

Protruding from the support portions 13 and 18 are attachment arms 15 and 20 respectively, straight rigid members aligned in parallel and spaced apart by a multiple of the distance between ladders rungs, for insertion into the openings in the ladder. Attachment arm 15 is sufficiently long to be inserted through both ladder rails and protrude out the end. A swivel tab 16 at the open end of the long attachment arm 15 may be turned to align with the arm. The diameter of the arm is such that the swivel and arm pass through standard ladder rung openings. The length of the swivel tab should be sufficiently greater than the diameter of the ladder rung openings to prevent the arm from being withdrawn when the swivel is turned perpendicular to the arm. The second attachment arm 20 is shorter than the first and contains no swivel.

Figure 2:
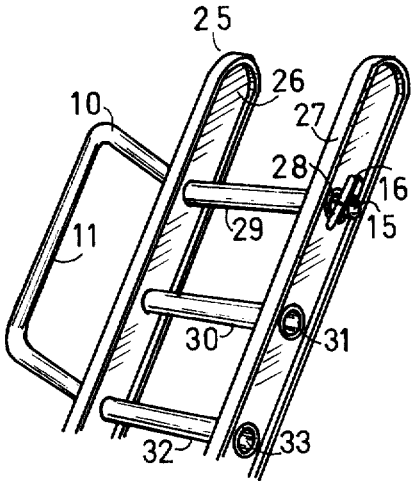
FIG. 2 is a perspective view of the preferred embodiment of the invention installed on an extension ladder.

In FIG. 2 the preferred embodiment of the removable handrail 10 is installed in place on an extension ladder. The longer arm 15 is inserted through the top or any other hollow rung 29 and out the rail opening 28, protruding a sufficient amount to permit the swivel to be turned out and secure the arm within the opening. Simultaneously the smaller attachment arm 20 is inserted into the opening 33 in the second rung 32 below the first arm 15. Only partial insertion is necessary because the secured longer arm 15 will hold the handrail in place. The spacing between arms may be equivalent to the distance between two adjacent rungs any whole-number multiple of that distance, thereby setting the length of the handrail according to the number of ladder rungs spanned. Rigidly secure in place, the handrail extends outwardly from the ladder for easy grasping by the climber.

Figure 3:
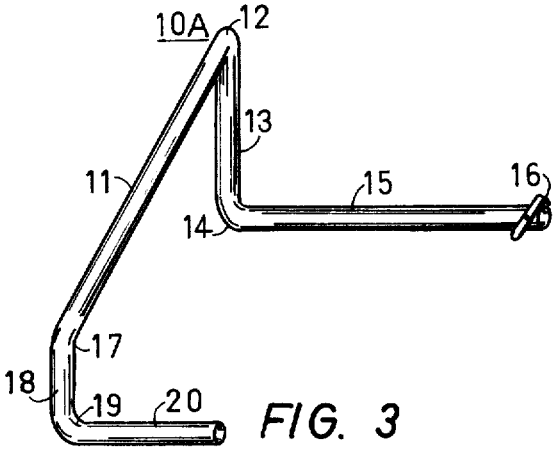
FIG. 3 is a perspective view of an alternate embodiment of the invention with a sloping handrail.

In FIG. 3 an alternate embodiment 10A provides supporting portions 13 and 18 of different lengths thereby creating a handrail which slopes relative to the ladder. The sloping handrail also differs by forming different angles 12 and 17 between the handrail portion 11 and the supports 13 and 18.

Figure 4:
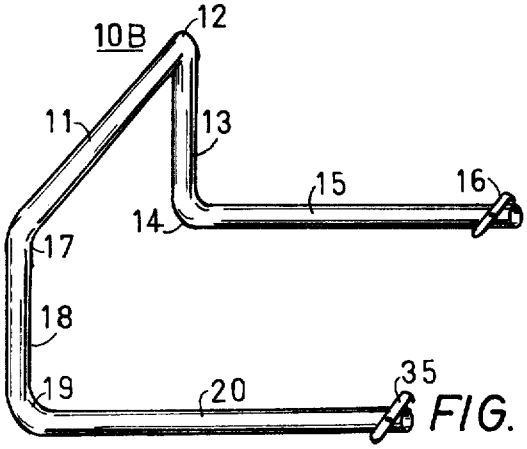
FIG. 4 is a perspective view of an alternate embodiment of the invention provided with two long attaching rods.

In FIG. 4 another alternate embodiment of the removable handrail 10B provides attachment arms 15 and 20 of equal length both of which are sufficiently long to pass completely through and beyond both ladder rails, and both of which are provided with swivels 16 and 35 at the open ends for double securement of the handrail to the ladder.

All of the embodiments are reversible so that they may be inserted on either rail of the ladder 26 or 27 for a left- or right-handed handrail.

Figure 5:
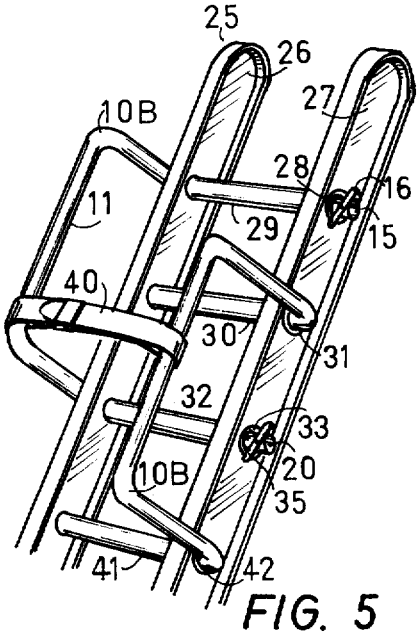
FIG. 5 is a perspective view of two handrails and retaining belt installed on an extension ladder.

In FIG. 5 a movable handrail 10B is mounted on each side of the ladder through alternate rungs: the upper rung 29 containing the upper attachment arm 15 of the left handrail and the next lower rung 30 containing the upper arm of the right handrail. Double security is provided by two handrails. A safety retaining device such as an adjustable belt 40 or chain or any other means may be secured between the two handrails to prevent the user from falling off the ladder.

Figure 6:
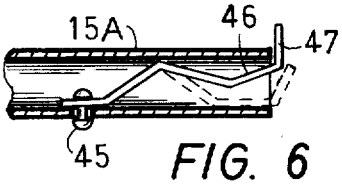
FIG. 6 is a crossectional view of the end of a long attachment arm with an alternate securing means.

In FIG. 6 an alternate embodiment of the securing means shows the end of a long attachment arm 15 provided with a tensioned bent metal bar 46 attached to the interior of the arm by standard means such as a rivet 45 through the wall of the attachment arm. The normally protruding end 47 of the bar beyond the arm perimeter acts as a stop to retain the arm within the ladder rung. By pressing down on the bar the end stop 47 is held within the perimeter of the arm circumference, as indicated by the dashed lines. In this lowered bar position the arm slides easily through the hollow ladder rung. After the arm is inserted completely through the rung and the end of the arm end protrudes beyond the ladder, the end 47 of the bar stop pops up under tension beyond the arm perimeter to act as a stop to retain the bracket in the ladder. Removal is accomplished by lowering the bar end 47 and sliding the arm out of the ladder.

Ease of installation and removal enables the use of removable handrails anywhere on the ladder. The user simply aligns the swivel tab 16 with the attachment arm 15, or both swivel tabs 16 and 35 with both attachment arms 15 and 20 in the case of two long arms as in FIG. 4, then slides the attachment arms 15 and 20 into the matching openings such as 28 and 33 or 31 and 42 in FIG. 5. When the end of the arms extend beyond the rail a sufficient distance the swivels 16 and 35 are turned approximately 90° to prevent the arms from slipping out of the ladder. Aligning the swivels with the attachment arms then enables the device to be slipped out again. The operation is so simple, the user may move the handrail to any location the user may be working on the ladder.

Although aluminum ladders with built-in openings through the rungs were indicated, the device may be applied to any ladder through which holes may be drilled, such as a wooden ladder. And although a one-piece bent construction of tubing was indicated, other rigid materials and a constructed fabrication method could be used to make the handrail such as pipes with threaded or soldered joints.

Safety, ease of use, simplicity of fabrication and versatile application to almost any ladder are some of the features which make the removable handrail a very useful new accessory for ladders.

It is understood that the preceding description is given merely by way of illustration and not in limitation of the invention and that various modifications may be made thereto without departing from the spirit of the invention as claimed.

I claim:

1. A single removable self-securing and side-reversible handrail for ladders comprising:

a ladder provided with at least one pair of horizontally aligned openings, and at least one separate opening spaced apart from the pair, all through the side rails of the ladder;

an elongated rigid straight handrail portion for manual grasping;

a rigid support portion permanently secured to and extending from each end of the handrail member to maintain the railing, in a fixed position spaced apart from the ladder;

a rigid elongated attaching portion permanently secured to each support away from the handrail portion, at least one of which attaching portions extends through both of the paired openings and the other of which attaching portions extends through at least one side rail opening; and a movable permanently attached means of removably securing the attaching portion within the paired openings.

2. The invention of claim 1 wherein the entire removable handrail is constructed of one continuous piece of material bent into the desired shape.

3. A single removable self-securing and side-reversible handrail for ladders comprising:

a ladder provided with at least one pair of horizontally aligned openings, and at least one other separate opening spaced apart from the pair, all through the side rails of the ladder;

a single rigid elongated member formed into a straight handrail portion, a support portion extending from each of two ends of the handrail portion, an attaching portion extending from each support portion which attaching portions are inserted through the openings in the side rails of the ladder, wherein at least one of the attaching portions extends through both ladder rails within paired openings and the other of which attaching portions extends through at least one side rail opening; and a movable permanently attached means of removably securing the attaching portion within the paired openings.

4. The invention of claims 1 or 3 wherein the securing means is an elongated swivel pin bent inwardly at an end and rotatably secured to a side of the end of the attaching portion so that when the swivel pin is aligned parallel with the attaching portion, the bent pin end stays in front of the attaching portion, and the two pass through openings in the ladder support and after passing through the opening the swivel rotates orthogonally to the attaching portion with the bent end drawn down by the pull of gravity, and prevents it from being withdrawn through the opening.

5. The invention of claims 1 or 3 wherein the securing means comprises a tensioned member permanently attached to the interior of the attaching portion; an end portion of which tensioned member normally protrudes under tension beyond the perimeter of the attaching portion, and which end portion may be moved temporarily within the perimeter of the attaching portion and after passing beyond the side rail opening the end portion protrudes beyond the side rail opening and the handrail is held within the ladder by the permanently attached tensioned member.

6. The invention of claims 1 or 3 wherein the attaching portions are of equal length permanently secured to the supports and both pass through paired openings in the ladder and each attaching portion is provided with a movable attached securing means at its extremity.

7. The invention of claims 1 or 3 wherein the support portions are of equal lengths and the straight handrail portion is in parallel alignment with the ladder at a safe distance for grasping.

8. The invention of claims 1 or 3 wherein the support portions are of unequal lengths so that the straight handrail portion slopes relative to the ladder to position the straight handrail equidistant from a user standing at an angle to the ladder.

9. The invention of claims 1 or 3 wherein one handrail is inserted on one side of the ladder and a second handrail is inserted on an opposite side of the ladder in alternate openings to provide a double set of straight parallel handrails.

10. The invention of claim 9 wherein a flexible retaining means is secured by a releasable means from one handrail to the other to restrain the user from falling off the ladder.

11. The invention of claims 1 or 3 wherein the openings through the ladder rails comprise hollow ladder rungs which open through each rail, one attaching portion passes completely through both side rails and the other attaching portion is shorter and passes through only one side rail.

12. The invention of claims 2 or 3 wherein the invention is fabricated of rigid cylindrical light weight tubing for ease of moving the single piece handrail on the ladder.

* * * * *